US012104829B2

(12) United States Patent
Felty et al.

(10) Patent No.: US 12,104,829 B2
(45) Date of Patent: Oct. 1, 2024

(54) DISPOSABLE DEVICES FOR HEATING BEVERAGE CONTAINERS

(71) Applicant: The PKF Company, LLC, Canton, MI (US)

(72) Inventors: Preston Keith Felty, Canton, MI (US); Keith Patrick Felty, Canton, MI (US)

(73) Assignee: The PKF Company, LLC, Canton, MI (US)

( * ) Notice: Subject to any disclaimer, the term of this patent is extended or adjusted under 35 U.S.C. 154(b) by 511 days.

(21) Appl. No.: 17/212,729

(22) Filed: Mar. 25, 2021

(65) Prior Publication Data

US 2021/0302071 A1 Sep. 30, 2021

Related U.S. Application Data

(60) Provisional application No. 62/994,359, filed on Mar. 25, 2020.

(51) Int. Cl.
*F24V 30/00* (2018.01)
*A47G 23/02* (2006.01)

(52) U.S. Cl.
CPC ..... *F24V 30/00* (2018.05); *A47G 23/0216* (2013.01); *A47G 2023/0291* (2013.01)

(58) Field of Classification Search
CPC ..... F24V 30/00; A47G 23/0216; A47G 2023/0291; B65D 77/206; B65D 81/3484
See application file for complete search history.

(56) References Cited

U.S. PATENT DOCUMENTS

| | | | | |
|---|---|---|---|---|
| 9,447,987 | B1 * | 9/2016 | Arvey | F24V 30/00 |
| 2016/0286994 | A1 * | 10/2016 | Felty | A47G 23/0216 |
| 2021/0137727 | A1 * | 5/2021 | Laubach | B32B 27/285 |
| 2022/0227564 | A1 * | 7/2022 | Pedicini | B65D 81/3484 |

* cited by examiner

*Primary Examiner* — Shawn M Braden
(74) *Attorney, Agent, or Firm* — Hartman Global IP Law; Gary M. Hartman; Domenica N. S. Hartman

(57) ABSTRACT

Disposable devices for maintaining the contents of containers, such as hot beverage cups, at or near a desired temperature for an extended period of time. The disposable devices include a sleeve having an inner surface, an outer surface, and a cavity that contains a heating element. The device is configured to define an interior passage that is sized and able to conform to an exterior shape of a container such that heat can be transferred from the heating element to the container. The device includes openings that allow air to contact and activate the heating element via initiation of a heat-generating reaction.

16 Claims, 15 Drawing Sheets

DISPOSABLE DEVICES FOR HEATING BEVERAGE CONTAINERS

CROSS-REFERENCE TO RELATED APPLICATIONS

This application claims the benefit of U.S. Provisional Application No. 62/994,359 filed Mar. 25, 2020, the contents of which are incorporated herein by reference. In addition, this application is related to co-pending U.S. patent application Ser. No. 16/192,985 filed Nov. 16, 2018, which is a continuation-in-part of U.S. patent application Ser. No. 15/088,762 filed Apr. 1, 2016, which claims priority to and all the benefit of U.S. Provisional Application No. 62/141,553 filed on Apr. 1, 2015, U.S. Provisional Application No. 62/587,584 filed Nov. 17, 2017 and U.S. Provisional Application No. 62/742,597 filed Oct. 8, 2018. The contents of each of these prior applications are also incorporated herein by reference.

BACKGROUND OF THE INVENTION

The present invention generally relates to devices capable of use with beverage containers, including but not limited to cups. The invention particularly relates to disposable devices having heating elements for heating beverage containers and the contents thereof.

A variety of insulating materials and phase-change materials are available that can be used as an insulator to assist with keeping the contents of a beverage container at or near a desired temperature for an extended period of time. One example of such an insulator is disclosed in U.S. Patent Application Publication Nos. 2016/0286994 and 2019/0082871, both to Felty et al., and incorporates a heating element that can be activated by exposure to air. Notwithstanding, further improvements in insulators for beverage containers are desirable.

BRIEF DESCRIPTION OF THE INVENTION

The present invention provides disposable devices that incorporate heating elements and are suitable for maintaining the contents of containers, as nonlimiting examples, hot beverage cups, at or near a desired temperature for an extended period of time.

According to various aspects of the invention, disposable devices are provided that include a sleeve having an inner surface, an outer surface, and a cavity that contains a heating element. The device is configured to define an interior passage that is sized and able to conform to an exterior shape of a container such that heat can be transferred from the heating element to the container. The device includes openings that allow air to contact and activate the heating element via initiation of a heat-generating reaction.

According to one aspect of the invention, a disposable device includes a sleeve having an inner surface and an outer surface, a housing supported with the sleeve and comprising a cavity and a heat-producing material in the cavity, openings in the housing that fluidically connect the cavity to the outer surface of the sleeve and allow air to contact and activate the heat-producing material in the cavity via initiation of a heat-generating reaction, and a releasable barrier film that seals the openings to prevent the heat-generating reaction.

Technical effects of devices as described above preferably include their ability to have or be initially arranged in a compact configuration that facilitates shipping and promotes aesthetics at the point of sale, while also providing an uncomplicated means by which the devices can be reconfigured to be placed around a beverage container and their heating elements activated (in some cases, simultaneously) to maintain an elevated temperature of the container's contents for an extended period of time. Certain embodiments are particularly directed to providing a combination of features that are able to facilitate air flow to a heating element, thermally insulate the heating element from outer surfaces of the device, and promote directional heat transfer away from the user and toward a container surrounded by the device through the selective use of thermal insulating and thermal reflecting materials, while offering an ergonomic product for human use.

Other aspects and advantages of this invention will be appreciated from the following detailed description.

DETAILED DESCRIPTION OF THE INVENTION

Figure 1:
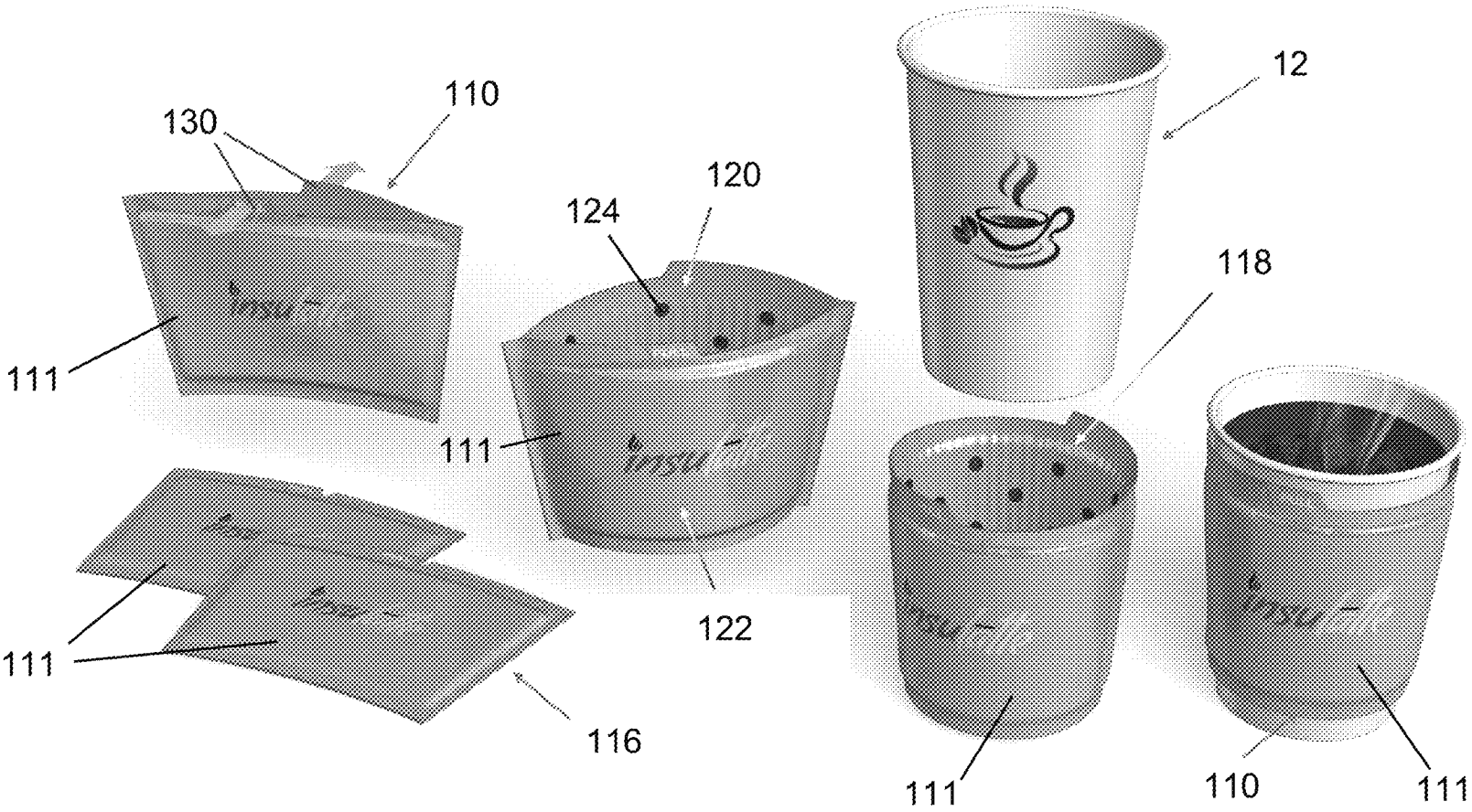
FIGS. 1 through 11 represent various views of eleven different disposable devices in accordance with certain but nonlimiting embodiments of the present invention.

The intended purpose of the following detailed description of the invention and the phraseology and terminology employed therein is to describe what is shown in the drawings, which include the depiction of one or more nonlimiting embodiments of the invention, and to describe certain but not all aspects of the embodiments depicted in the drawings. The following detailed description also identifies certain but not all alternatives of the depicted embodiments. Therefore, the appended claims, and not the detailed description, describe what is at least provisionally believed to be one or more aspects of the invention.

FIGS. 1 through 18 represent various embodiments of disposable devices that are configured to contact a container and incorporate one or more heating elements that produce sufficient heat to keep contents within the container at desired temperatures for longer periods of time than would occur without the use of the disposable devices. The disposable devices are equipped with various releasable sealing means that prevent the heating elements from being activated via initiation of a heat-generating reaction. Although the drawings represent the containers as cups 12 having a tapered exterior shape, the disposable devices may be configured to contact other types of containers, such as food containers, plates, bowls, mugs, etc. The disposable devices are related to other devices disclosed in U.S. Patent Application Publication Nos. 2016/0286994 and 2019/0082871 to Felty et al., incorporated herein by reference in their entirety. Certain details of the disposable devices disclosed herein regarding materials, manufacture, and use may be substantially the same as or similar to devices disclosed in these previous patent applications, and therefore will not be discussed in detail herein. The disposable devices in their entirety are preferably disposable, which as used herein means that the disposable devices are intended for single use, will be damaged by cleaning in a conventional automatic dishwasher, and are formed entirely of materials that can be recycled and/or legally and safely disposed of as solid waste in a landfill.

The disposable devices are equipped with holes that allow air to contact and activate the heating elements to initiate the heat-generating reaction, and the releasable sealing means of the disposable devices are operable to seal the holes to prevent the heat-generating reaction until such time as decided by the user. Though a variety of materials and combinations of materials may be used as the heating elements on the basis of being capable of undergoing a heat-generating reaction, including materials reported in U.S. Patent Application Publication Nos. 2016/0286994 and 2019/0082871, heating elements that undergo oxygen-activated reactions are believed to be preferred. Examples of materials that can be used to produce oxygen-activated reactions when exposed to air include iron and/or zinc, which may be used in combination with diffuser materials and catalysts.

FIG. 1 represents a disposable device 110 in accordance with a first embodiment. The disposable device 110 is in the form of a collapsible/expandable sleeve 111 (a tubular-shaped article with oppositely-disposed open ends) formed by a liner that defines an inner surface 120 and an outer surface 122 of the sleeve 111. The sleeve 111 has two halves that are generally mirror images of each other. Each half includes a heating element disposed within a cavity defined between the inner and outer surfaces 120 and 122. The inner surface 120 of the sleeve 111 includes multiple openings or holes 124 configured to expose the heating elements (partially visible through the holes 124) to air and thereby initiate a heat-generating reaction. The disposable device 110 is configured to be arranged in a compact (folded) configuration 116 in which portions of the inner surface 120 associated with each half of the sleeve 111 contact one another such that the disposable device 110 is substantially flat or planar. In this configuration, the inner surface 120 is part of a releasable sealing means by which the perimeters of the holes 124, portions of the inner surface 120 around the holes 124, or the entirety of the inner surface 120 can be sealed, for example, in combination with an adhesive, such that portions of the heating elements exposed by the holes 124 are not in contact with air. The disposable device 110 is configured such that the halves of the sleeve 111 may be peeled or pulled apart in opposite directions to arrange the disposable device 110 in an expanded configuration 118 having a tubular shape with an interior passage that is sized and can conform to the tapered shape of the cup 12. The disposable device 110 may include tabs 130 configured to promote ease of peeling apart the halves. When the halves are pulled apart or otherwise separated, the seal created by the inner surface 120 around the holes 124 is broken and the heating elements are exposed to air, thereby initiating the heat-generating reaction. Preferably, portions of the inner surface 120 include corrugated channels configured to promote air flow to the holes 124 between the cup 12 and the inner surface 122 of the sleeve 111 when the sleeve 111 surrounds and contacts the cup 12 as shown in FIG. 1.

Figure 2:
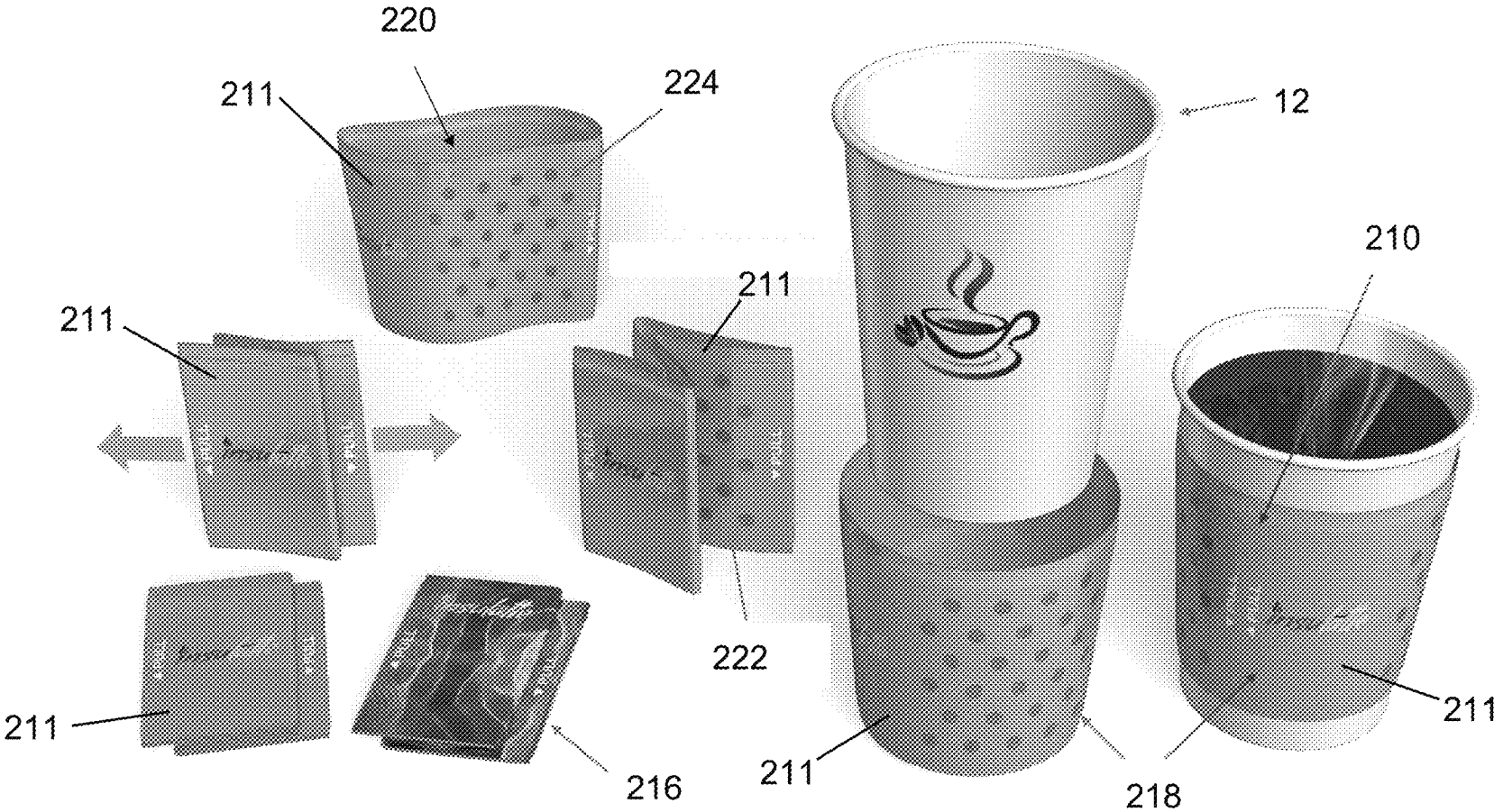

FIG. 2 represents a disposable device 210 in accordance with a second embodiment. The disposable device 210 is in the form of a collapsible/expandable sleeve 211 formed by a liner that defines an inner surface 220 and an outer surface 222 of the sleeve 211. The sleeve 211 has multiple sections with heating elements disposed within cavities defined by and between the inner and outer surfaces 220 and 222 of the sleeve 211 in at least some of the sections (for example, four of the sections). Portions of the outer surface 222 that are adjacent sections of the sleeve 211 that include a heating element include multiple openings or holes 224 configured to expose the heating elements (partially visible through the holes 224) to air and thereby initiate a heat-generating reaction. The disposable device 210 is configured to be arranged in an accordion-type compact (folded) configuration 216 in which adjacent portions of the outer surface 222 of the sleeve 211 that include the heating elements and holes 224 contact one another. In this configuration, the outer surface 222 is part of a releasable sealing means by which the perimeters of the holes 224, portions of the outer surface 222 around the holes 224, or the entirety of these sections of the outer surface 222 can be sealed, for example, in combination with an adhesive, such that portions of the heating elements exposed by the holes 224 are not in contact with air. The disposable device 210 is configured such that sides of the sleeve 211 may be pulled apart in opposite directions to arrange the disposable device 210 in an expanded configuration 218 in which the sleeve 211 has a tubular shape with an interior passage that is sized and can conform to the shape of the cup 12. When the sides of the sleeve 211 are pulled apart, the seal(s) around the holes 224 is broken and the heating elements are exposed to air thereby initiating the heat-generating reaction.

Figure 3:
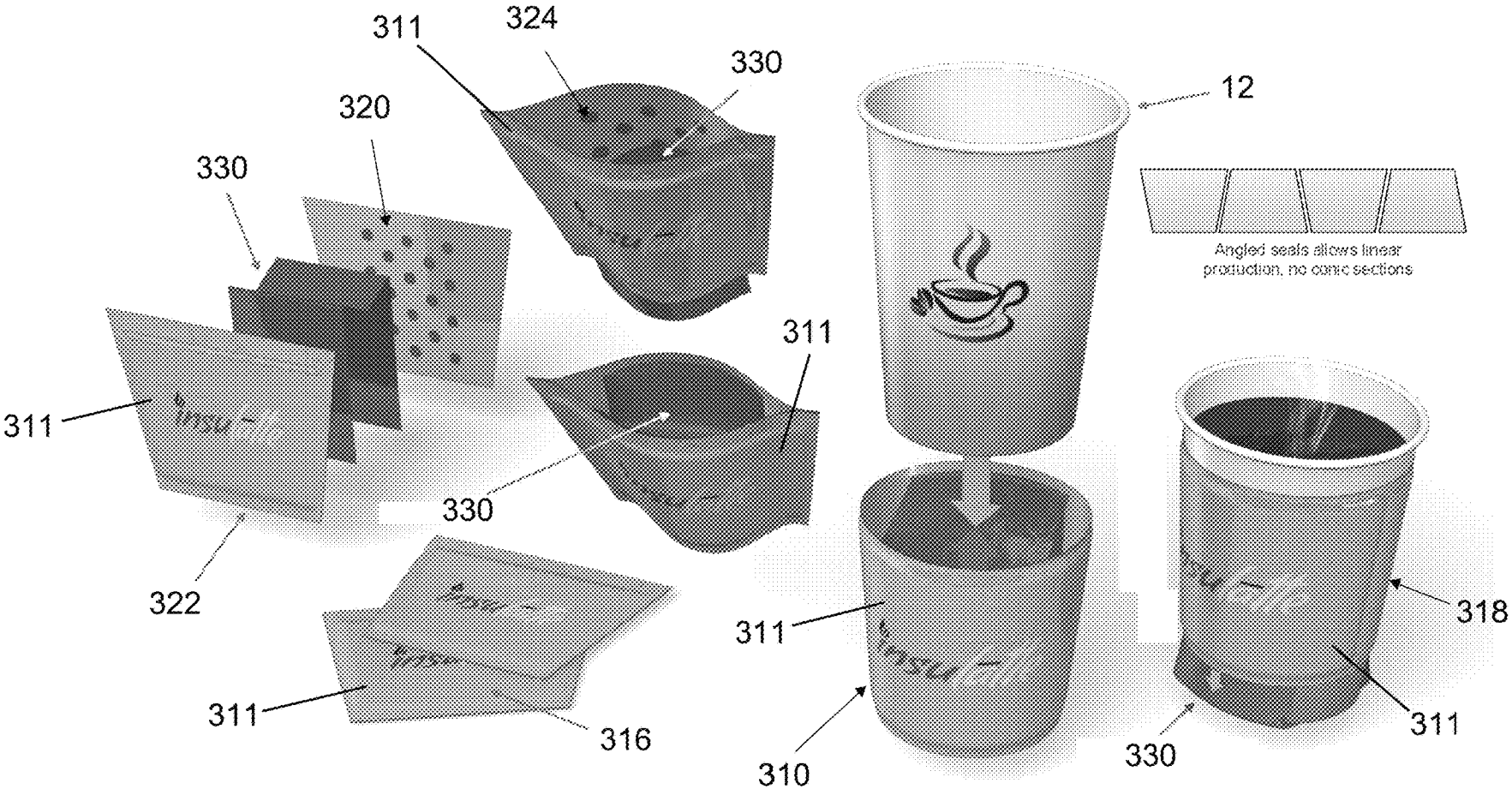

FIG. 3 represents a disposable device 310 in the form of a collapsible/expandable sleeve 311 in accordance with a third embodiment. Similar to the embodiment of FIG. 1, the sleeve 311 comprises a liner that defines an inner surface 320 and an outer surface 322 of the sleeve 311, two halves that are generally mirror images of each other, and a heating element disposed within a cavity in each half between the inner and outer surfaces 320 and 322. The inner surface 320 of the sleeve 311 includes multiple openings or holes 324 configured to expose the heating elements (partially visible through the holes 324) to air and thereby initiate a heat-generating reaction. The disposable device 310 is configured to be arranged in a compact (folded) configuration 316 in which the inner surface 320 of the sleeve 311 associated with each half contacts at least one intermediate barrier layer ("ribbon") 330 therebetween, so that the layer 330 is sandwiched between the halves when the disposable device 310 is substantially flat or planar in the compact configuration 316. In this configuration, the inner surface 320 and barrier layer 330 are parts of a releasable sealing means by which the perimeters of the holes 324, portions of the inner surface 320 around the holes 324, or the entirety of the inner surface 320 can be sealed, for example, in combination with an adhesive, such that portions of the heating elements exposed by the holes 324 are not in contact with air. The disposable device 310 is configured such that the halves of the sleeve 311 may be pulled apart or otherwise sufficiently separated to expose the inner surface 320 and cause the sleeve 311 to acquire a tubular shape with an interior passage that is sized and can conform to the shape of the cup 12, with the barrier layer 330 bridging the interior passage. As the cup 12 is inserted into the opening, the cup 12 contacts the barrier layer 330 and forces the barrier layer 330 through the passage such that the barrier layer 330 is peeled or separated from portions of the inner surface 320 of the sleeve 311 to break the seal around the holes 324, expose the heating elements to air, and initiate the heat-generating reaction. Once the cup 12 is fully inserted into the disposable device 310, the sleeve 311 will have acquired an expanded configuration 318 and, as shown, the barrier layer 330 may serve as a cradle supporting the cup 12 within the disposable device 310.

Figure 4:
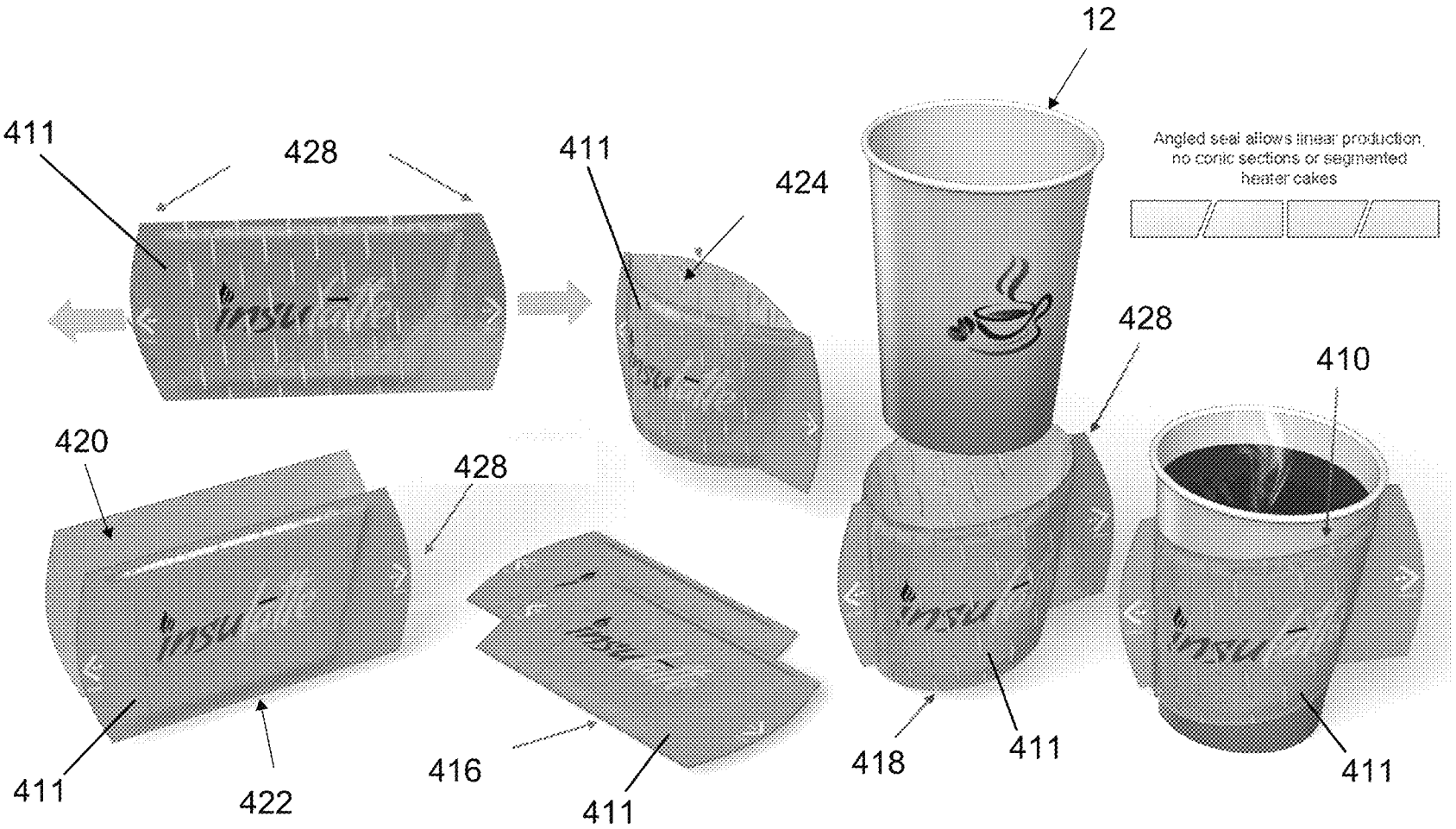

FIG. 4 represents a disposable device 410 in the form of a collapsible/expandable sleeve 411 in accordance with a fourth embodiment. Similar to the embodiments of FIGS. 1 and 3, the sleeve 411 comprises a liner that defines an inner surface 420 and an outer surface 422 of the sleeve 411, two halves that are generally mirror images of each other, and a heating element disposed within a cavity in each half between the inner and outer surfaces 420 and 422. The disposable device 410 is configured to be arranged in a compact (folded) configuration 416 in which portions of the inner surface 420 associated with each half of the sleeve 411 contact one another such that the disposable device 410 is substantially flat or planar. In this configuration, the heating elements are not exposed to or in contact with air. The disposable device 410 includes a pair of oppositely disposed tabs or "wings" 428 that are configured to be pulled in opposite directions to peel or separate the halves of the sleeve 411 to arrange the disposable device 410 in an expanded configuration 418 in which the sleeve 411 has a tubular shape with an interior passage that is sized and can conform to the shape of the cup 12. In the compact (folded) configuration 416, the sleeve 411 includes multiple slits partially cut or formed in the outer surface 422. When the wings 428 are pulled to transition the disposable device 410 to the expanded configuration 418, tension on the sleeve 411 causes the slits to tear open and form openings or holes 424 that are capable of exposing the heating elements (partially visible through the holes 424) to air and thereby initiate a heat-generating reaction. In this configuration, the sleeve 411 and its inner and outer surfaces 420 and 422 serve as a releasable sealing means that seals the holes 424. Optionally, the portions of the inner surface 420 associated with each half of the sleeve 411 may each have a rhomboid-like shape, such that when the cup 12 is inserted into the interior passage of the sleeve 411, the interior passage of the sleeve 411 contacts and conforms to the cup 12 along all or most of its height.

Figure 5:
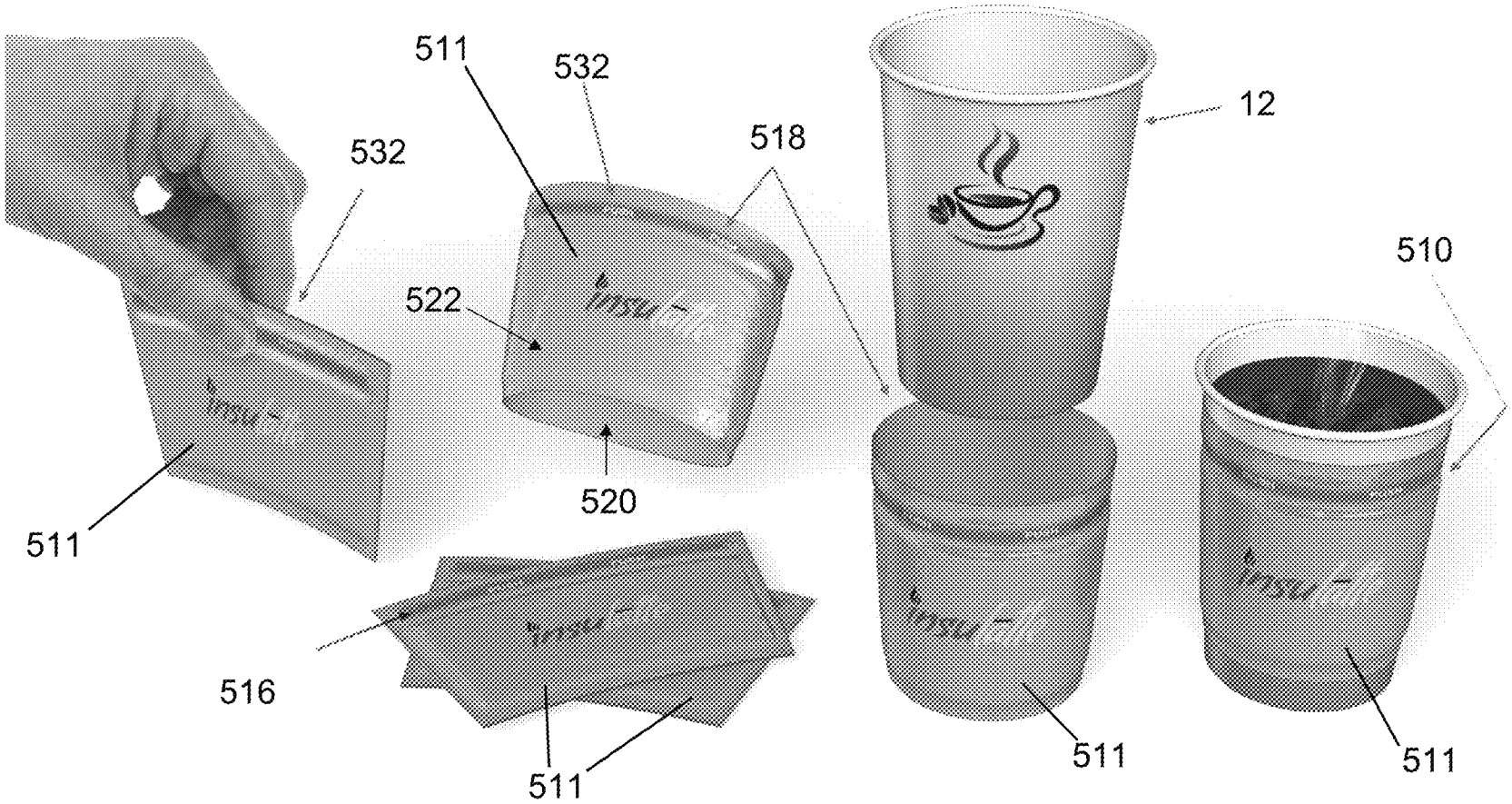

FIG. 5 represents a disposable device 510 in the form of a collapsible/expandable sleeve 511 in accordance with a fifth embodiment. Similar to the embodiments of FIGS. 1, 3, and 4, the sleeve 511 comprises a liner that defines inner and outer surfaces 520 and 522 of the sleeve 511, two halves that are generally mirror images of each other, and a heating element disposed within a cavity in each half between the inner and outer surfaces 520 and 522 of the sleeve 511. The disposable device 510 is configured to be arranged in a compact (folded) configuration 516 in which portions of the inner surface 520 associated with each half of the sleeve 511 contact one another such that the disposable device 510 is substantially flat or planar, and configured such that the halves of the sleeve 511 may be pulled apart or otherwise separated to arrange the disposable device 510 in an expanded configuration 518 in which the sleeve 511 has a tubular shape with an interior passage that is sized and can conform to the shape of the cup 12. Each half of the sleeve 511 includes a reservoir 532 that is between the inner and outer surfaces 520 and 522 of the sleeve 511 and contains an oxidizing agent, such as $O_2$, air, or $NO_2$. The sleeve 511 is configured such that application of sufficient compression on each of the reservoirs 532 (in some cases, while transitioning from the compact to expanded configurations) will cause seals between the reservoirs 532 and the heating elements to break, enabling the oxidizing agent to contact the heating element and initiate a heat-generating reaction. In this configuration, the sleeve 511 and its reservoirs 532 are parts of a releasable sealing means that prevents the heat-generating reaction until the reservoirs 532 are breached. Optionally, the oxidizing agents within the reservoirs 532 may be selectively released to control activation of the heating elements over time.

Figure 6:
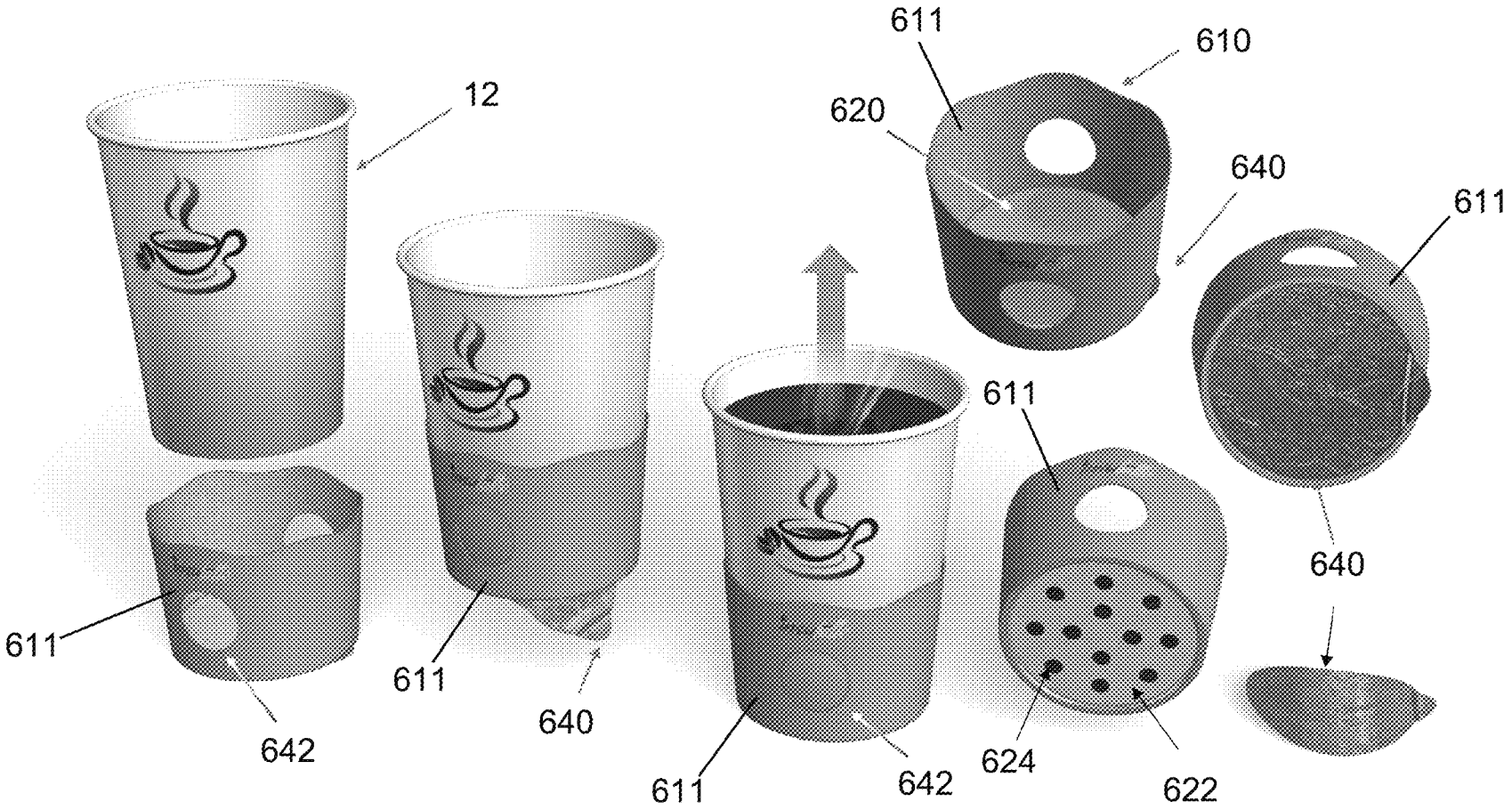

FIG. 6 represents a disposable device 610 in accordance with a sixth embodiment. The disposable device 610 has a cup-like shape that includes side walls that define a sleeve 611 that is capable of conforming to the tapered shape of the cup 12, a base that closes one end of the disposable device 610, and an opening opposite the base so that in combination the base and side walls define a cavity configured to receive a limited portion of the lower end of a cup 12. The base includes an inner surface 620 adjacent the cavity, an outer surface 622, and a heating element disposed within a cavity defined between the inner and outer surfaces 620 and 622. The outer surface 622 of the base includes multiple openings or holes 624 configured to expose the heating element (partially visible through the holes 624) to air and thereby initiate a heat-generating reaction. A barrier layer 640 is secured to the outer surface 622 of the base, for example with an adhesive, to seal the holes 624 and prevent air from contacting portions of the heating element exposed by the holes 624. The barrier layer 640 is configured to be peeled and separated from the outer surface 622 of the base to expose the heating element to air and initiate a heat-generating reaction. In this configuration, the barrier layer 640 and the outer surface 622 are parts of a releasable sealing means by which the holes 624 are sealed. Preferably, the barrier layer 640 includes a tab to promote ease of removal. Optionally, the side walls may include side openings 642 to allow a user to directly grip the cup 12 through the side openings 642.

Figure 7:
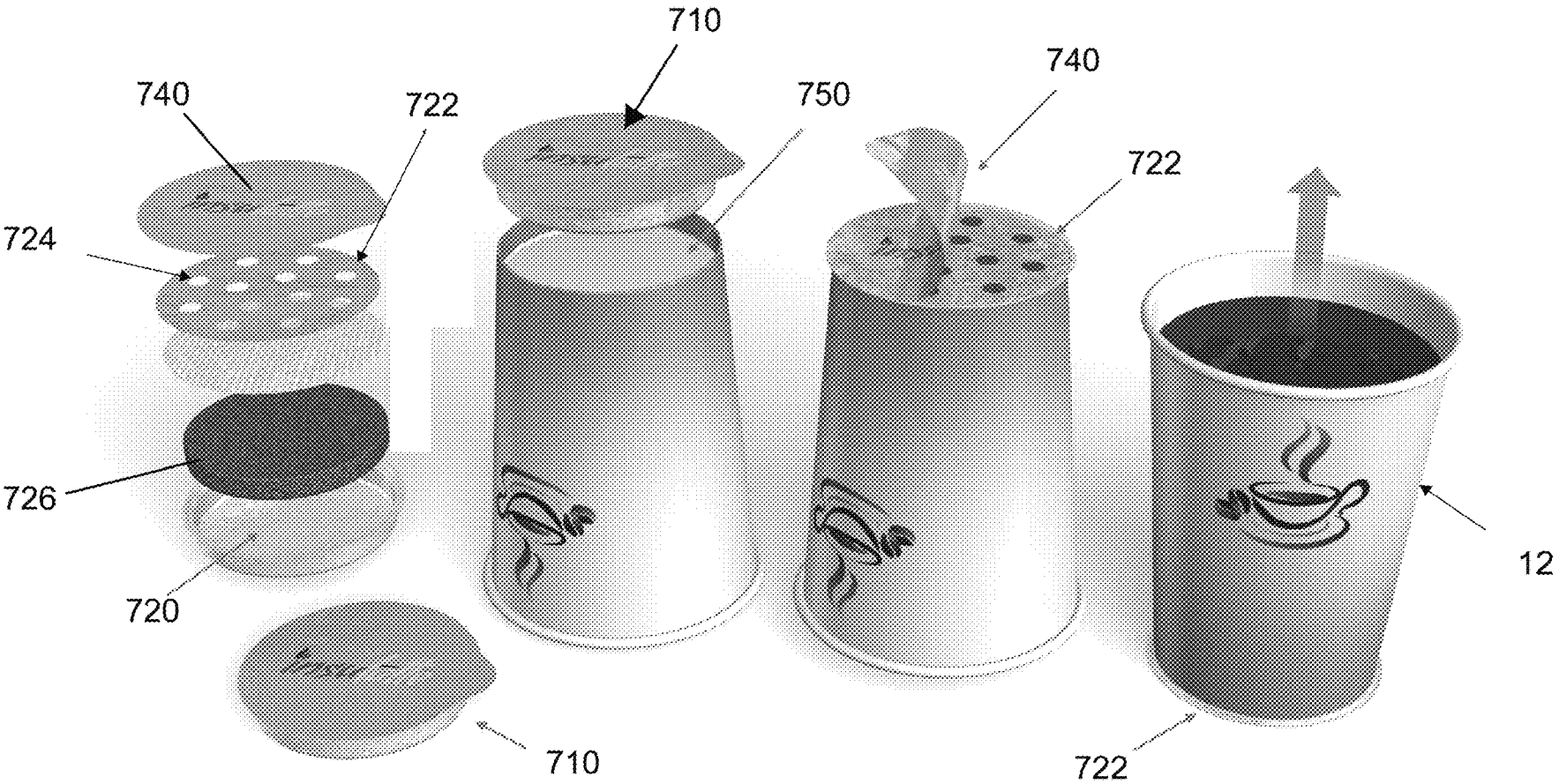

FIG. 7 represents a disposable device 710 in accordance with a seventh embodiment. The disposable device 710 is generally in the form of a disk-shaped body having a first end wall 720 that serves as an inner surface for contacting a cup 12, a side wall that adjoins the first end wall 720 to define therewith a cavity, a heating element 726 within the cavity, and a second end wall 722 that closes the cavity and will serve as an outer surface of the disposable device 710. The first end wall 720 and at least a portion of the side wall are sized and shaped to be received within a recess 750 at the bottom of the cup 12. The second end wall 722 includes multiple openings or holes 724 configured to expose the heating element 726 to air and thereby initiate a heat-generating reaction. A barrier layer 740 is secured to the second end wall 722, for example with an adhesive, to seal the holes 724 and prevent air from contacting portions of the heating element 726 exposed by the holes 724. The barrier layer 740 is configured to be peeled and separated from the second end wall 722 to expose the heating element 726 to air and initiate a heat-generating reaction. In this configuration, the barrier layer 740 and the second end wall 822 are parts of a releasable sealing means by which the holes 724 are sealed. The barrier layer 740 may include a tab to promote ease of removal. Optionally, the second end wall 722 may have a larger diameter or dimension than the sidewall or first end wall 720 such that when coupled with the cup 12, edges of the second end wall 722 extend beyond the cup 12 to signal to observers that the disposable device 710 is attached and potentially active.

Figure 8:
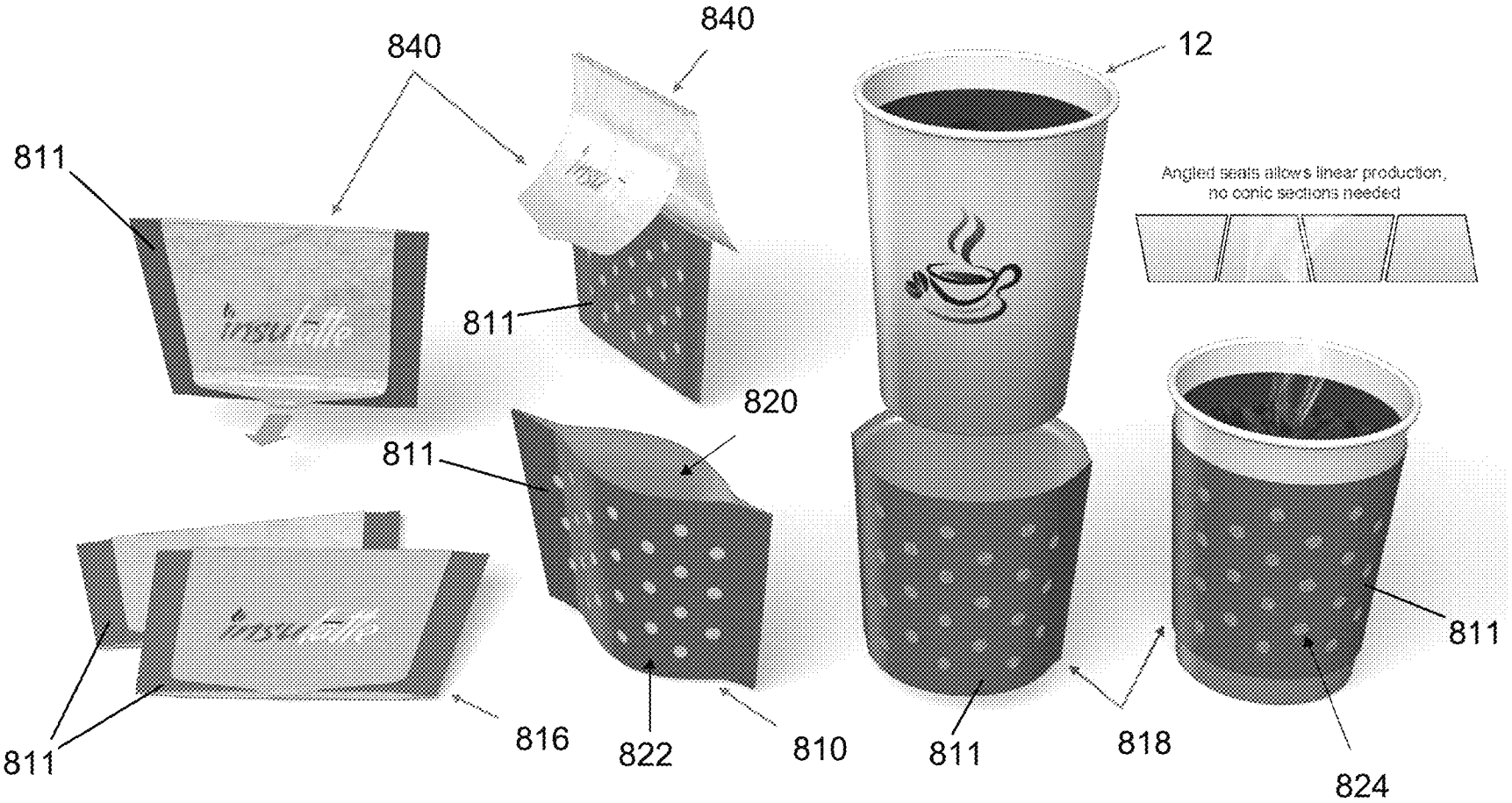

FIG. 8 represents the disposable device 810 in the form of a collapsible/expandable sleeve 811 in accordance with an eighth embodiment. Similar to the embodiments of FIGS. 1, 3, 4, and 5, the sleeve 811 comprises a liner that defines inner and outer surfaces 820 and 822 of the sleeve 811, two halves that are generally mirror images of each other, and a heating element disposed within a cavity in each half between the inner and outer surfaces 820 and 822 of the sleeve 811. The disposable device 810 is configured to be arranged in a compact (folded) configuration 816 in which portions of the inner surface 820 associated with each half of the sleeve 811 contact one another such that the disposable device 810 is substantially flat or planar. The disposable device 810 is also configured such that the halves of the sleeve 811 may be squeezed, pulled apart, or otherwise separated to arrange the disposable device 810 in an expanded configuration 818 in which the sleeve 811 has a tubular shape with an interior passage that is sized and can conform to the shape of the cup 12. The outer surface 822 of the sleeve 811 includes multiple openings or holes 824 configured to expose the heating element (partially visible through the holes 824) to air and thereby initiate a heat-generating reaction. While arranged in the compact (folded) configuration 816, a barrier layer 840 is secured to the outer surface 822 associated with each half of the sleeve 811, for example with an adhesive, to seal the holes 824 and prevent air from contacting portions of the heating element exposed by the holes 824. The barrier layer 840 is configured to be peeled and separated from the outer surface 822 of each half of the sleeve 811 to expose the heating element to air and initiate a heat-generating reaction. In this configuration, the barrier layer 840 and the outer surface 822 are parts of a releasable sealing means by which the holes 824 are sealed. Preferably, the barrier layer 840 includes a tab to promote ease of removal. In the embodiment of FIG. 8, both halves of the sleeve 811 have a trapezoidal shape in the compact (folded) configuration 816 such that, once transitioned to the expanded configuration 818, the disposable device 810 is capable of conforming to the shape of the cup 12.

Figure 9:
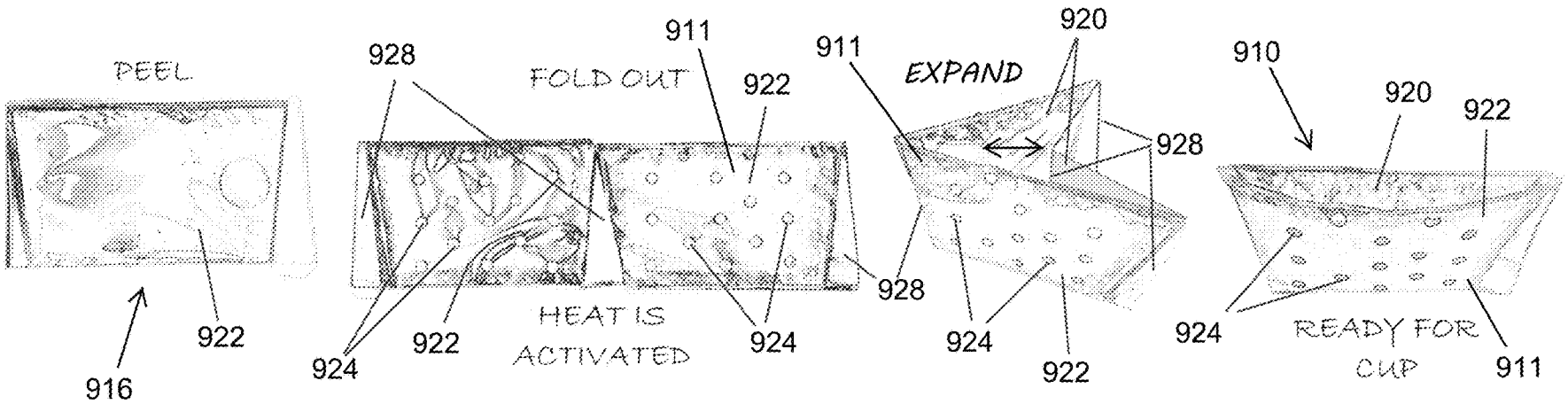

FIG. 9 represents a disposable device 910 in the form of a collapsible/expandable sleeve 911 in accordance with a ninth embodiment. The sleeve 911 comprises a liner that defines four rectangular or trapezoidal panels, which together define inner and outer surfaces 920 and 922 of the sleeve 911 once fully expanded. Each adjacent pair of panels is permanently joined along a shared edge 928 therebetween. Two of the panels contain heating elements within cavities, such that approximately 180 degrees of a container (not shown) placed in the disposable device 910 is directly warmed by a heating element. Holes 924 are formed in portions of the outer surface 922 associated with the two panels that contain the heating elements (partially visible through the holes 924) so that once the holes 924 are exposed to air the heating elements initiate a heat-generating reaction. The disposable device 910 is configured to be initially arranged in a compact (folded) configuration 916 in which portions of the inner surface 920 of adjacent pairs of panels face and contact each other, portions of the outer surface 922 formed by the two panels containing the heating elements and holes 924 contact and are sealed against one another such that the disposable device 910 is substantially flat or planar, its holes 924 are covered, and the portions of the outer surface 922 formed by the two panels that do not contain the heating elements and holes 924 are on the exterior of the compact configuration 916. As such, the inner surfaces 920 and the portions of the outer surface 922 formed by the two panels that do not contain heating elements serve as releasable sealing means that seal the holes 924 to prevent the heat-generating reaction. The disposable device 910 of FIG. 9 is initially opened in a manner similar to a book, for example, by grasping two of its shared edge 928 and using the edges 928 as tabs to peel the panels apart and unfold the panels to expose the holes 924. The disposable device 910 is then expanded by separating the portions of the inner surface 920 apart from each other to create an interior passage within the disposable device 910 into which a container can be inserted.

Figure 10:
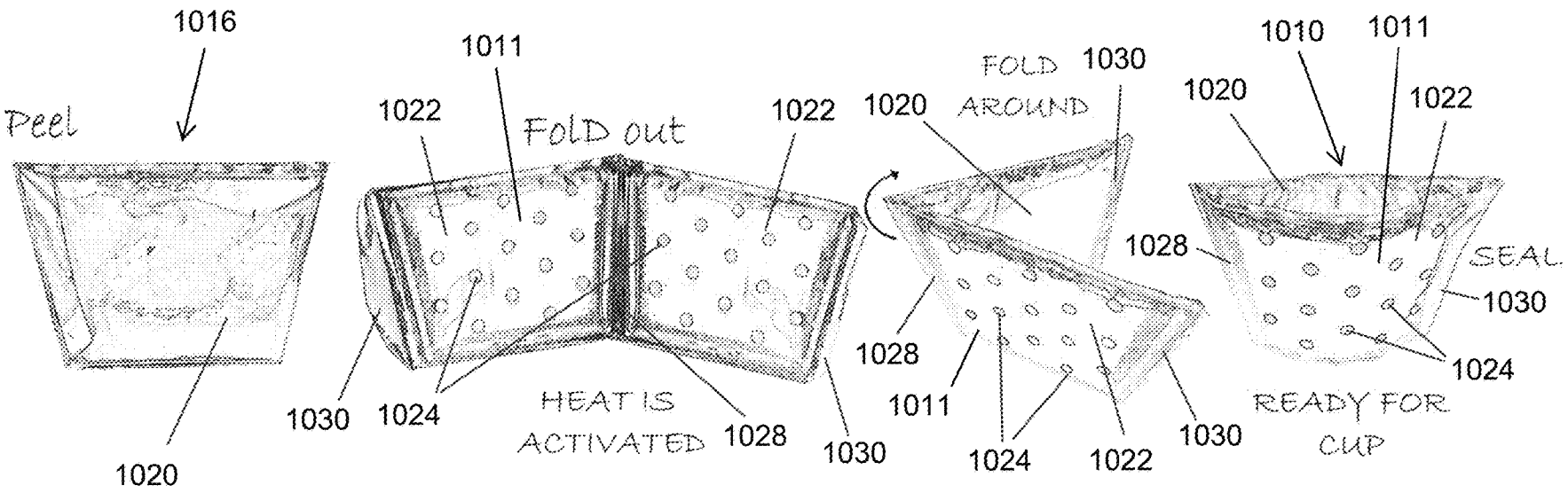

FIG. 10 represents a disposable device 1010 in the form of a collapsible/expandable sleeve 1011 in accordance with a tenth embodiment. The disposable device 1010 is similar to the disposable device 910 of FIG. 9, but its sleeve 1011 comprises a liner having only two rectangular or trapezoidal panels that define inner and outer surfaces 1020 and 1022 of the sleeve 1011. Both panels contain heating elements and holes 1024, such that approximately 360 degrees of a container (not shown) placed in the disposable device 1010 is directly warmed by a heating element (partially visible through the holes 1024) once the holes 1024 are exposed to air to enable the heating elements to initiate a heat-generating reaction. The panels are permanently joined along one shared edge 1028 and releasably attached to each other with an adhesive along oppositely-disposed distal edges 1030. The disposable device 1010 is configured to be arranged in a compact (folded) configuration 1016 in which the two portions of the outer surface 922 formed by the two panels face and contact each other and are sealed against one another such that the disposable device 1010 is substantially flat or planar, its holes 1024 are covered, and the two portions of the inner surface 1020 formed by the panels are on the exterior of the compact configuration 1016. As such, the inner and outer surfaces 920 and 922 of the sleeve 1011 serve as releasable sealing means that seal the holes 924 to prevent the heat-generating reaction. The disposable device 1010 of FIG. 10 is initially opened in a manner similar to a book, for example, by peeling apart its distal edges 1030 and unfolding the panels to expose the holes 1024. The disposable device 1010 can then be wrapped around a container (not shown) with the inner surface 1020 facing the container, the outer surface 1022 facing outward, and the distal edges 1030 brought together and adhered to each other to create an interior passage within the disposable device 1010 that contains the container.

Figure 11:
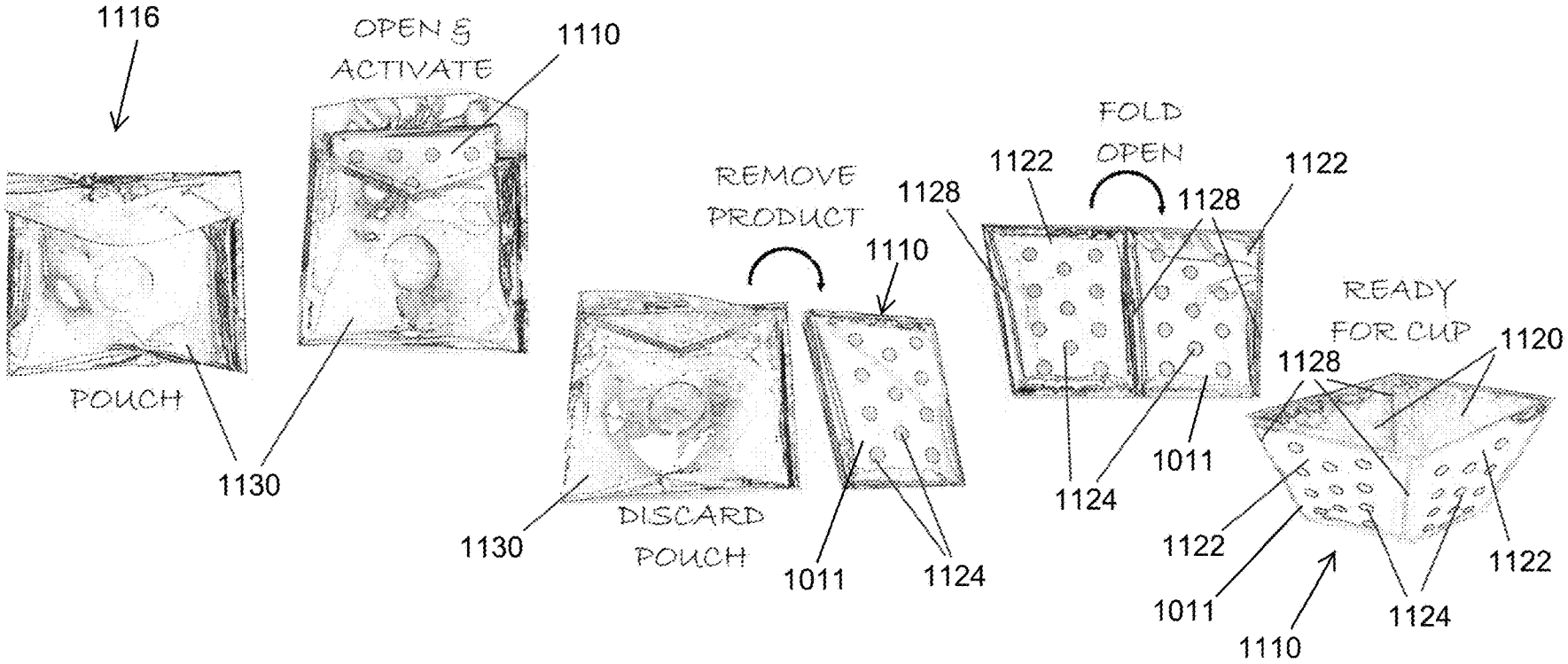

FIG. 11 represents a disposable device 1110 in the form of a collapsible/expandable sleeve 1111 used in combination with a sealed envelope 1130 in accordance with an eleventh embodiment. The disposable device 1110 is folded and resides within the sealed envelope 1130 until ready for use. As with the disposable device 910 of FIG. 9, the sleeve 1111 shown in FIG. 11 comprises a liner having four rectangular or trapezoidal panels that define inner and outer surfaces 1120 and 1122 of the sleeve 1111 once fully expanded. Each adjacent pair of panels is permanently joined along a shared edge 1128 therebetween. All of the panels contain heating elements, such that 360 degrees of a container placed in the disposable device 1110 is directly warmed by a heating element that is partially visible through holes 1124 that are formed in each portion of the outer surface 1122 associated a panel. As with the disposable device 910 of FIG. 9, the disposable device 1110 is also configured to be arranged in a compact (folded) configuration 1116 in which portions of the inner surface 1120 of adjacent pairs of panels face and contact each other. In contrast to the disposable device 910 of FIG. 9, portions of the outer surface 1122 formed by two adjacent panels face and contact each other and portions of the outer surface 1122 formed by the two remaining panels face outward to form the exterior of the compact configuration 1116, which is substantially flat or planar. Because the holes 1124 at the outer surfaces 1122 of two panels are exposed in the compact configuration 1116, the disposable device 1110 is initially sealed within the envelope 1130, which once opened allows the disposable device 1110 to be unfolded to expose all of the holes 1124. The disposable device 1110 is then expanded by separating the portions of the inner surface 1120 apart from each other to create an interior passage within the disposable device 1110 into which a container can be inserted.

FIGS. 12 through 17 represent a disposable device 1210 in the form of a collapsible/expandable sleeve 1211 in accordance with a twelfth embodiment. The embodiment of FIGS. 12 through 17 is particularly directed to providing a combination of features that are able to facilitate air flow to a heating element, thermally insulate the heating element from outer surfaces of the device 1210, and promote directional heat transfer away from the user and toward a container (cup 12) surrounded by the device 1210 through the selective use of thermal insulating and thermal reflecting materials, while offering an ergonomic product for human use.

Figure 14:
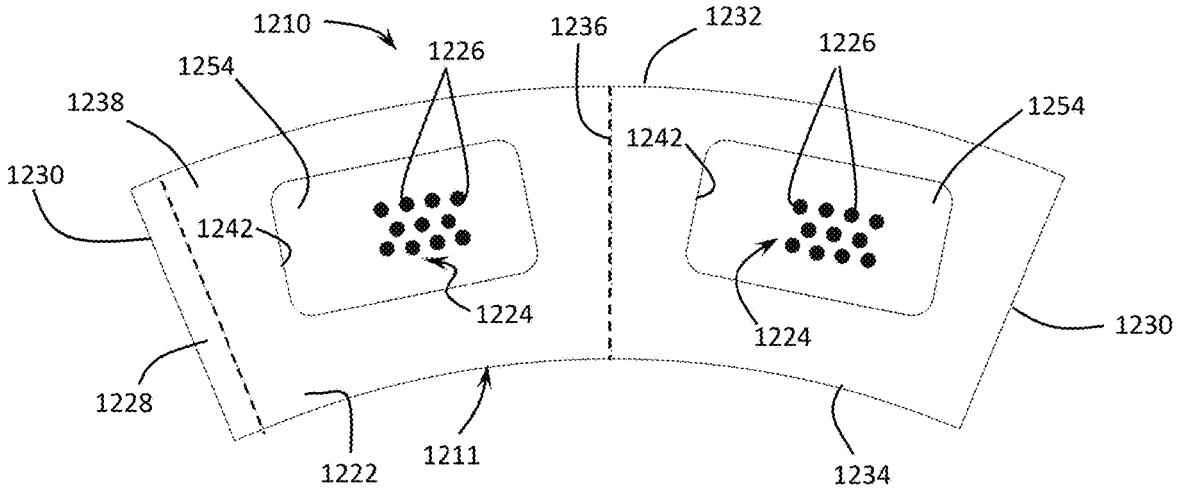
Figure 15:
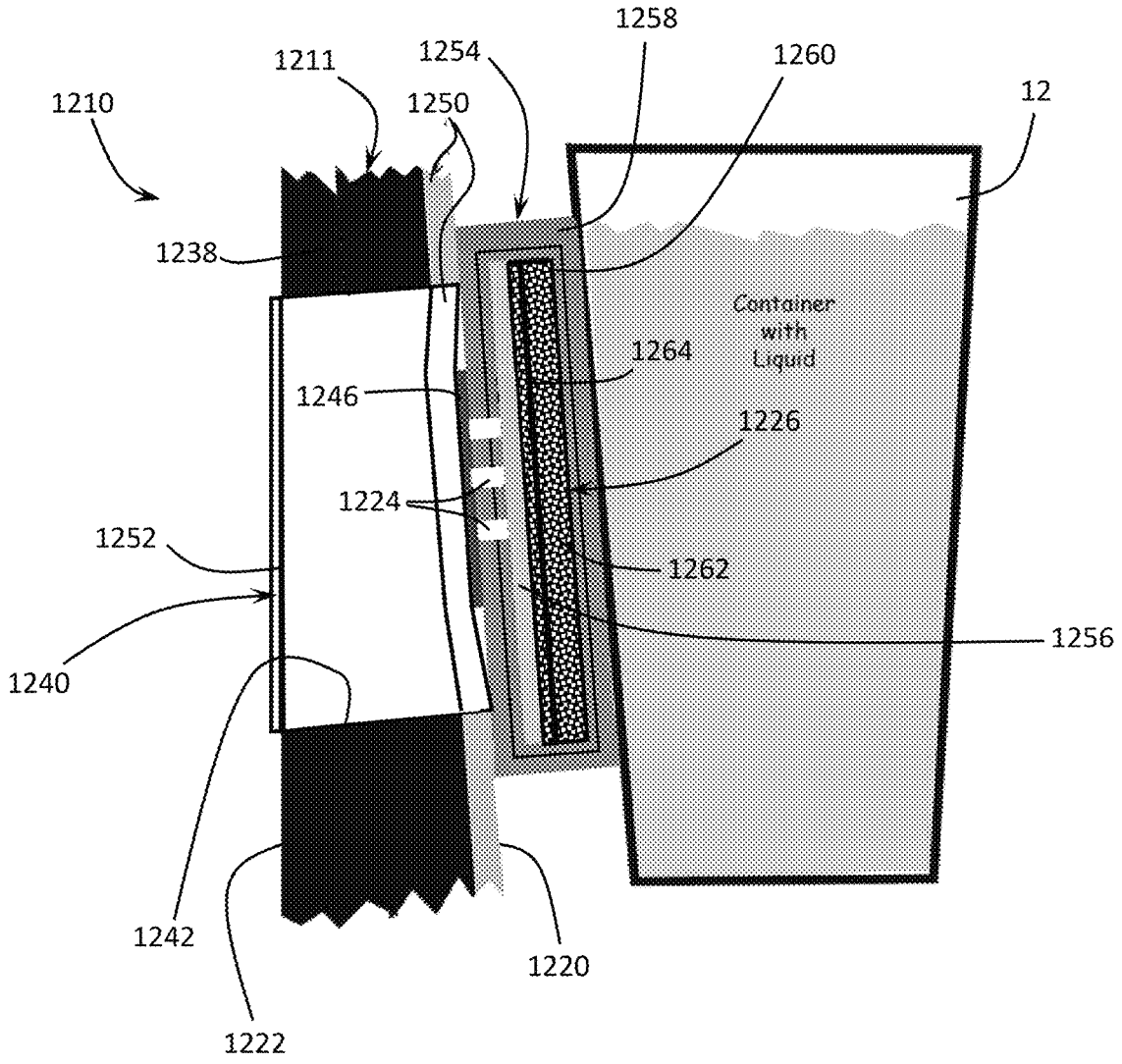
FIGS. 15, 16, and 17 represent cross-sectional views of the disposable device of FIGS. 12 through 15, and represent steps taken to activate heating elements within the devices.
Figure 16:
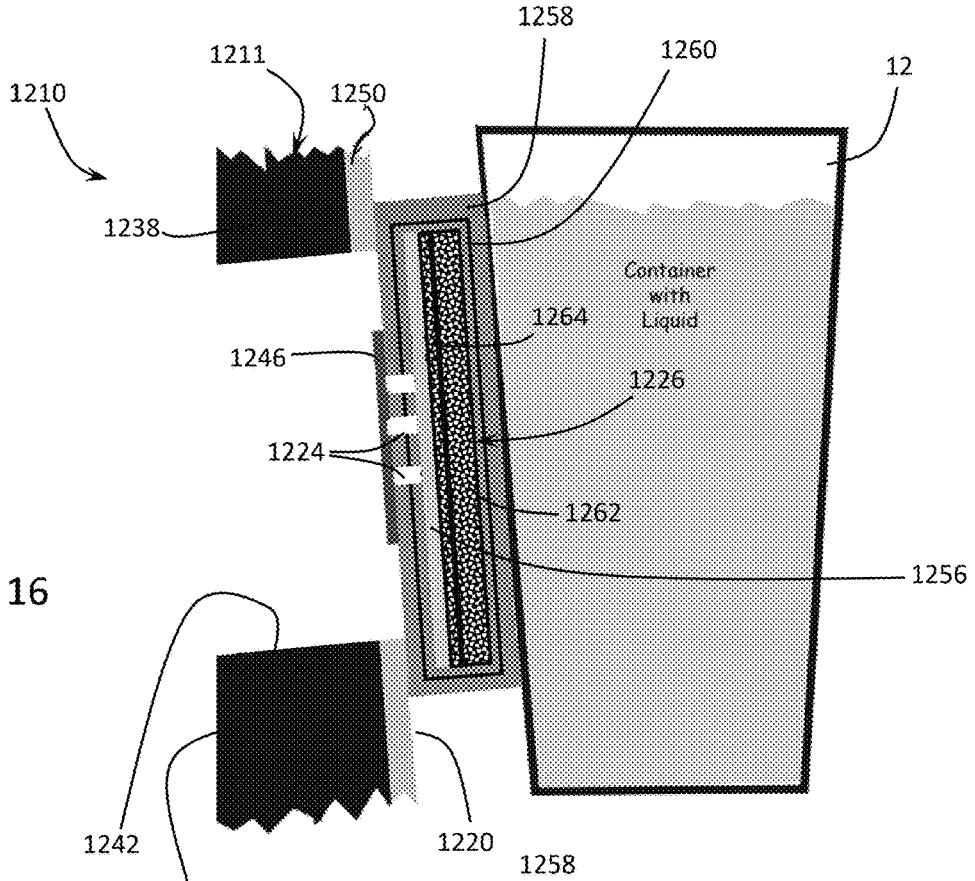
Figure 17:
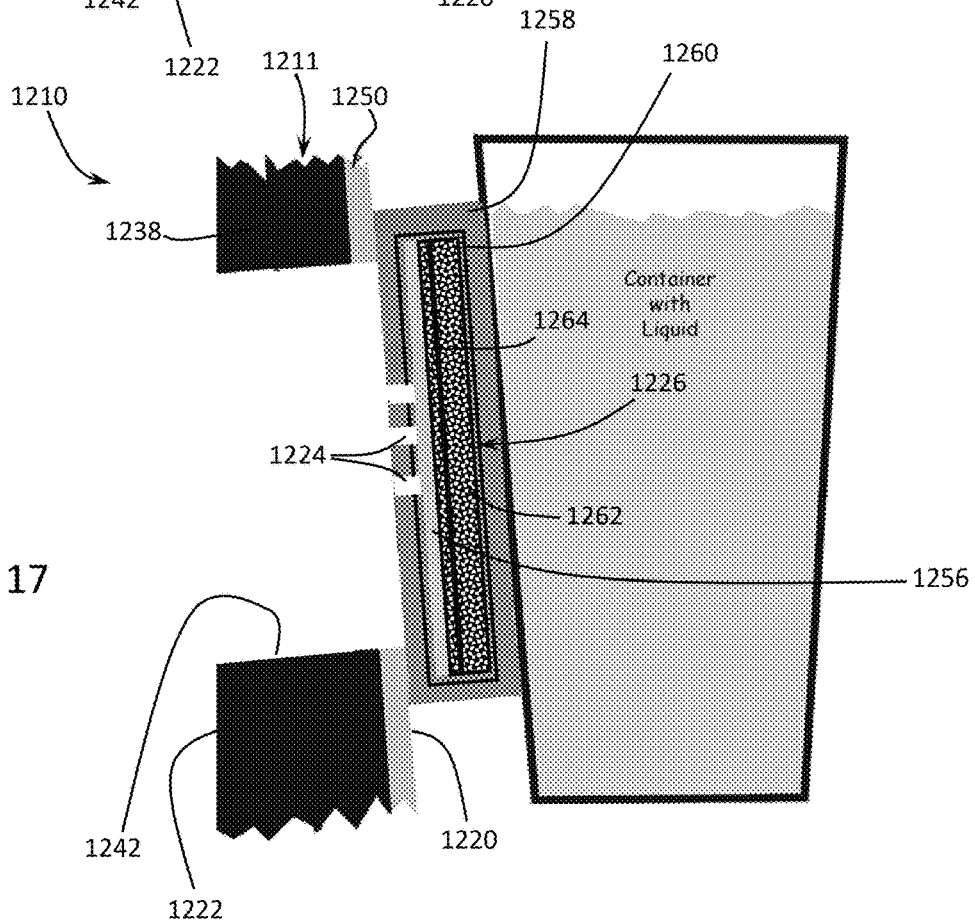

In contrast to the prior embodiments of FIGS. 1 through 11, the sleeve 1211 of the disposable device 1210 is not expanded to create an interior passage to receive a container, but instead is initially configured as a planar (flat) band or strip having opposite ends or edges 1230 that may be permanently or temporarily joined together, as a nonlimiting example, using a pressure-sensitive adhesive 1228, so that the sleeve 1211 can acquire and maintain a tubular shape with an interior passage (not shown) that can be sized and shaped to conform to the outer shape of a cup 12 (FIGS. 15 through 17). It should be appreciated that FIGS. 12 through 17 are not drawn to scale, and instead are scaled to promote an understanding of the embodiment of the invention illustrated in these drawings.

Figure 12:
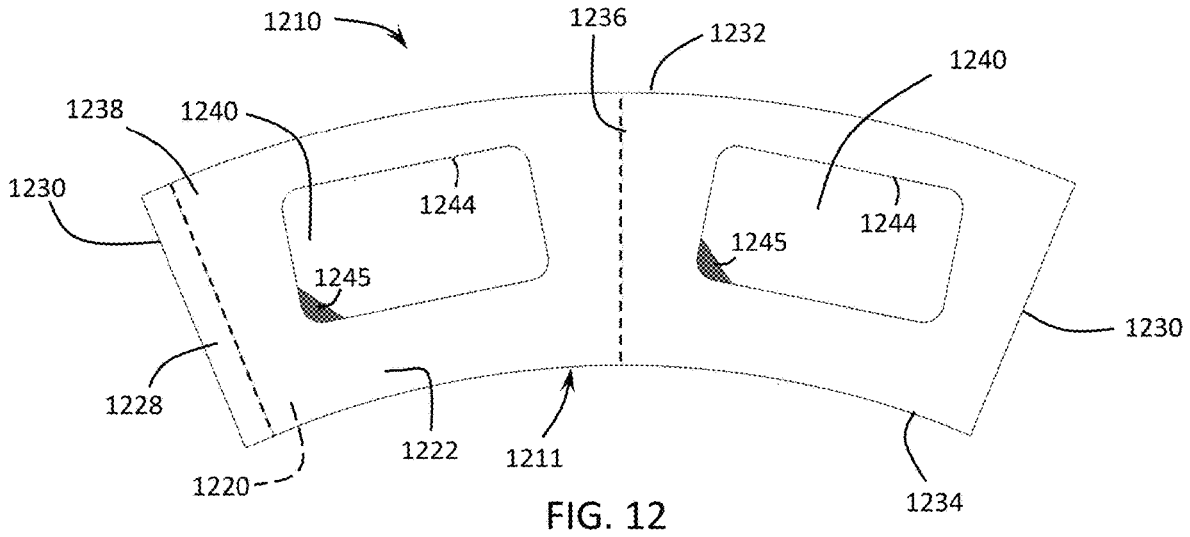
FIGS. 12, 13, and 14 represent front views of a disposable device in accordance with another nonlimiting embodiment of the present invention, and represent steps taken to activate heating elements within the devices.
Figure 13:
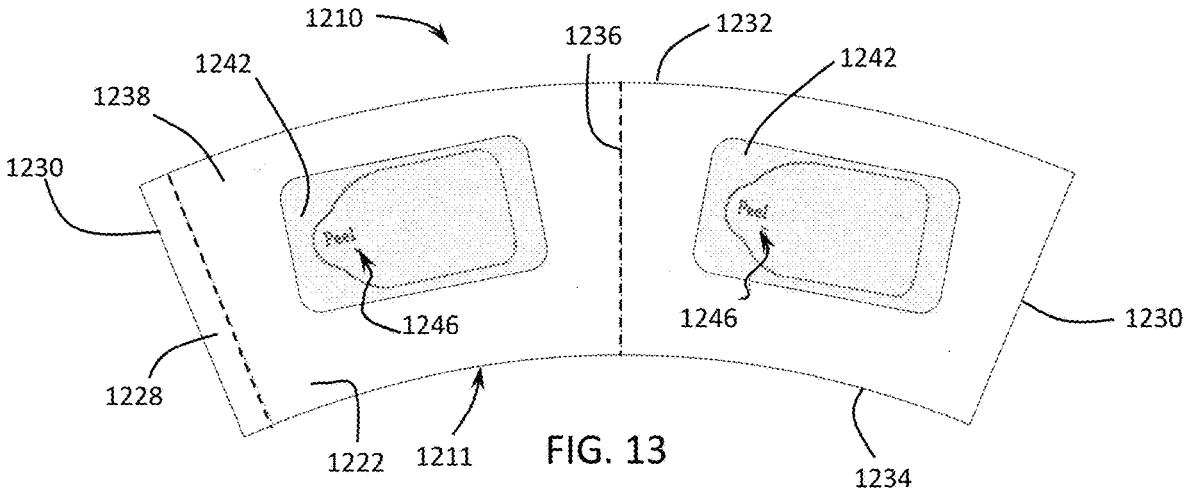

As evident from FIGS. 12 through 14, the sleeve 1211 initially has an arcuate shape prior to being reconfigured to have a tubular shape, as generally represented in FIGS. 15 through 17 depicting the sleeve 1211 surrounding a cup 12. The sleeve 1211 has an inner surface 1220 and an oppositely-disposed outer surface 1222, and an upper edge 1232 and an oppositely-disposed lower edge 1234. A crease 1236 may be defined between the edges 1230 by which the sleeve 1211 may be folded to provide a more compact configuration. The sleeve 1211 has a multilayer construction as evident from FIGS. 15 through 17. The outer surface 1222 of the sleeve 1211 may be entirely formed by an outer layer 1238 constructed of a single material, preferably a flexible thermal insulating material such as cardboard, though the use of various other materials and combinations of materials are also within the scope of the invention, as nonlimiting examples, cork, expanded polystyrene foam insulation (for example, STYROFOAM®), and combinations thereof.

FIG. 12 represents an initial state of the disposable device 1210 in which covers 1240 cover and close recesses 1242 (FIG. 13) defined in the sleeve 1211. The covers 1240 may be die cut from the outer layer 1238 to form perforations 1244 instead of a complete cut, such that the covers 1240 are secured to the outer layer 1238 with multiple ties (not shown) that are sufficient to hold the covers 1240 within their respective recesses 1242. FIG. 12 depicts a corner of each cover 1240 being removed to create a niche 1245 that enables a user to lift the covers 1240 from their recesses 1242. The peripheral shape of the covers 1240 is not believed to be critical other than to provide adequate exposure to the recesses 1242, below which heating elements 1226 are disposed and preferably utilize air flow for activation.

FIG. 13 represents the result of removing the covers 1240 to expose the recesses 1242, as well as a peelable barrier film 1246 within each recess 1242. FIG. 14 represents the result of removing the barrier films 1246 to expose openings or holes 1224 that provide air passages to the heating elements 1226, which lie directly beneath the holes 1224. The barrier films 1246 serve to exclude air and moisture from the holes 1224 and the underlying heating elements 1226, and may be releasably secured to the surfaces of the sleeve 1211 within the recesses 1242 by an adhesive, as a nonlimiting example, a pressure-sensitive adhesive.

The cross-sectional views of FIGS. 15 through 17 represent a nonlimiting example for the construction of the disposable device 1210 and its sleeve 1211, schematically shown assembled with a cup 12. The cross-section is representative of the construction of the sleeve 1211 through one of the covers 1240 and its associated recess 1242 and heating element 1226. The sleeve 1211 is represented as having a second layer 1250 applied to the interior surface of the outer layer 1238. The second layer 1250 is preferably a heat reflective layer, for example, a metallized layer attached to the outer layer 1238. Metallization on the interior of the sleeve 1211 is desirable to promote the ability of the sleeve 1211 to maintain the contents of the cup 12 at an elevated temperature. As represented, the cover 1240 is represented as die cut from the outer layer 1238, and as a result also carries the second layer 1250 on its interior surface. The cover 1240 of the sleeve 1211 is further represented as having an optional label 1252 applied to its outer surface. The label 1252 can be useful to provide a surface on which instructions for the user may be printed and/or to provide a tab (not shown) that can be used by the user to assist with lifting the cover 1240 out of the recess 1242.

In FIG. 14, the floor of each recess 1242 is identified with reference number 1254, which in FIGS. 15 through 17 is represented as being defined by a discrete housing 1254 that forms an internal cavity 1256 in which the heating element 1226 is contained. Though the housing 1254 is represented in FIGS. 15 through 17 as a separate component that is attached to the interior surface of the sleeve 1221, it is foreseeable that the housing 1254 could be integrated directly into the sleeve 1211, utilizing one or more layers of the sleeve 1211 to construct one or more portions of the housing 1254. As shown in FIGS. 15 through 17, the holes 1224 fluidically connect the cavity 1256 to the outer surface 1222 of the sleeve 1211 so that, once the cover 1240 and barrier film 1246 are removed from their recess 1242, air is able to access the heating element 1226 within the cavity 1256 through the holes 1224. Together, the cover 1240 and barrier film 1246 necessitate a two-step operation to activate the heating element 1226. Prior to their removal, the cover 1240 protects the barrier film 1246 from being accidently or surreptitiously tampered with in a manner that would be sufficient to activate the heating element 1226 prior to its intended use. In this regard, the cover 1240 is able to promote the shelf life of the disposable device 1210 and also serve as a tamper barrier.

The housing 1254 is represented as having a multilayer construction comprising at least an outer insulator layer 1258 and an inner barrier layer 1260. As a nonlimiting example, the housing 1254 may be a laminate formed by a polyester (e.g., Mylar®) film and a metallized oriented polypropylene (OPP) as the insulator layer 1258 and the barrier layer 1260, respectively. OPP materials are believed to be particularly well suited as a material for the barrier layer 1260 of the housing 1254 because they offer a reliable barrier to moisture and oxygen. In addition, the metallization of the OPP material enables the barrier layer 1260 to perform as a thermal reflecting layer that reflects heat directionally toward the cup 12 and not toward the outer surface 1222 of the sleeve 1211. The exterior of the housing 1254 may be bonded to the interior surface of the sleeve 1211, for example, the second layer 1250, that surrounds the recess 1252.

The heating element 1226 is represented in FIGS. 15 through 17 as comprising at least two components, including a material 1262 that produces heat, as a nonlimiting example, a combination of iron and/or zinc that undergoes an oxygen-activated reaction when exposed to air. The second component of the heating element 1226 is preferably an insulating layer 1264 that minimizes the loss of heat from the cavity 1256 through the recess 1242 without negatively effecting the flow rate of air to the heat-producing material 1262, thereby promoting heat transfer from the housing 1154 to the cup 12. A particularly suitable material for this purpose is believed to be a spun-bond polypropylene. As known in the art, spun-bond polypropylene is a particular material characterized by open porosity that allows air flow therethrough while simultaneously providing an insulation effect by trapping heat within the porosity. Used as the insulating layer 1264, spun-bond polypropylene has been found to enable air required for the heat-generating reaction within the heat-producing material 1262 to be drawn through the insulating layer 1264 toward the heat-producing material 1262, while preventing or at least inhibiting heat generated by the heat-producing material 1262 from escaping outward through the holes 1224 and instead directing the heat inward toward the cup 12, effectively providing one-way directional heating to help facilitate heat transfer toward the cup 12. Other benefits of spun-bond polypropylene as the insulating layer 1264 include its ability to offer an ergonomic grip and its ability to be imprinted. As a result, the size of the holes 1224 may be much larger than shown in the drawings to expose a much larger surface of the insulating layer 1264, optionally to the extent that the insulating layer 1264 is contacted by the user's hand when the user grips the sleeve 1211 without conducting excessive heat to the user's hands, and offering a relatively large surface for imprinting, branding, and messaging.

As evident from FIGS. 15 through 17, the heating element 1226 preferably only occupies a portion of the cavity 1256, with a void present between the insulating layer 1264 and the openings 1224 so that the entire outer surface of the heat-producing material 1262 is exposed to air that enters the cavity 1256 through the openings 1224 and passes through the insulating layer 1264.

The configuration represented in FIG. 15 corresponds to FIG. 12. FIG. 16 represents the appearance of the sleeve 1211 after the removal of the cover 1240, corresponding to FIG. 13, and FIG. 17 represents the appearance of the sleeve 1211 after the removal of the barrier film 1246, corresponding to FIG. 14.

Figure 18:
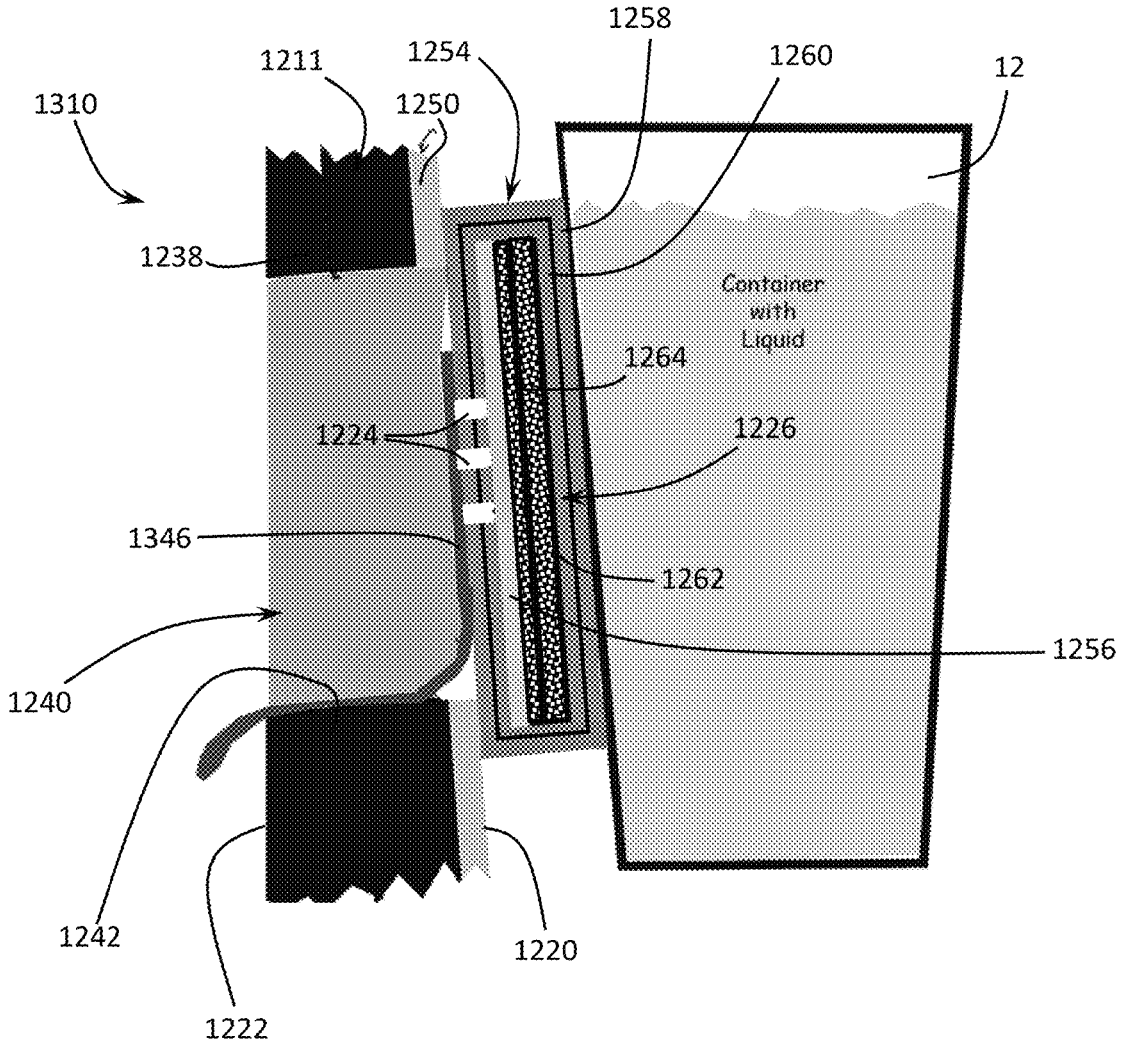
FIG. 18 represents a cross-sectional view of a disposable device in accordance with another nonlimiting embodiment of the present invention.

FIG. 18 represents a disposable device 1310 that may be identical to the device 1210 of FIGS. 12 through 17, the intended difference being the configuration of the barrier film 1346. Instead of completely underlying the cover 1240 (as is the case with the barrier film 1246 of FIGS. 12 through 17), a portion, extension, or attachment to the barrier film 1346 of FIG. 18 is shown as extending past the cover 1240 and defining a tab 1346A that protrudes from the recess 1242 so that the tab 1346A can be grasped and pulled to assist in removing the cover 1240 from the recess 1242. All other aspects described for the embodiment of FIGS. 12 through 17 can otherwise also be applicable to the embodiment of FIG. 18. It should again be appreciated that FIG. 18 is not drawn to scale, and instead FIG. 18 is scaled to promote an understanding of the embodiment of the invention illustrated in this drawing.

It is within the scope of the embodiments of FIGS. 12 through 18 that the cover 1240 could be omitted, such that use of the disposable devices 1210 and 1310 and activation of their heat-producing materials 1262 could be achieved by solely removing their barrier films 1246 and 1346.

While the invention has been described in terms of specific or particular embodiments, it should be apparent that alternatives could be adopted by one skilled in the art. For example, the disposable devices and their components could differ in appearance and construction from the embodiments described herein and shown in the drawings, functions of certain components of the disposable devices could be performed by components of different construction but capable of a similar (though not necessarily equivalent) function, and various materials could be used in the fabrication of the disposable devices and/or their components, including various diffuser materials and catalysts. In addition, the invention encompasses additional or alternative embodiments in which one or more features or aspects of a particular embodiment could be eliminated or two or more features or aspects of different disclosed embodiments could be combined. Accordingly, it should be understood that the invention is not necessarily limited to any embodiment described herein or illustrated in the drawings. It should also be understood that the phraseology and terminology employed above are for the purpose of describing the disclosed embodiments, and do not necessarily serve as limitations to the scope of the invention. Therefore, the scope of the invention is to be limited only by the claims.

The invention claimed is:

1. A disposable device adapted to maintain contents of a container at or near a desired temperature for an extended period of time, the disposable device comprising:

a sleeve having an inner surface and an outer surface;

a housing supported with the sleeve, the housing comprising a cavity and a heat-producing material in the cavity;

openings in the housing that fluidically connect the cavity to the outer surface of the sleeve, the openings allowing air to contact and activate the heat-producing material in the cavity via initiation of a heat-generating reaction; and a releasable barrier film that seals the openings to prevent the heat-generating reaction;

wherein the housing comprises an outer insulator layer and an inner barrier layer, and the inner barrier layer is a thermal reflecting layer that reflects heat away from the outer surface of the sleeve and toward the inner surface of the sleeve.

2. The disposable device of claim 1, wherein the housing is a separate component attached to the inner surface of the sleeve.

3. The disposable device of claim 1, further comprising an insulating layer within the cavity and between the openings and the heat-producing material to inhibit loss of heat from the cavity through the openings.

4. The disposable device of claim 3, wherein the insulating layer and the heat-producing material occupy a portion of the cavity and a void is present within the cavity between the openings and the insulating layer.

5. The disposable device of claim 1, wherein the inner barrier layer is a metallized oriented polypropylene (OPP).

6. The disposable device of claim 1, further comprising a tamper barrier that completely covers the barrier film.

7. The disposable device of claim 1, further comprising a tamper barrier that partially covers the barrier film.

8. A disposable device adapted to maintain contents of a container at or near a desired temperature for an extended period of time, the disposable device comprising:

a sleeve having an inner surface and an outer surface;

a housing supported with the sleeve, the housing comprising a cavity and a heat-producing material in the cavity;

openings in the housing that fluidically connect the cavity to the outer surface of the sleeve, the openings allowing air to contact and activate the heat-producing material in the cavity via initiation of a heat-generating reaction; and a releasable barrier film that seals the openings to prevent the heat-generating reaction;

wherein the sleeve has a recess defined in the outer surface thereof, and the housing is disposed in the recess.

9. The disposable device of claim 8, further comprising a tamper barrier disposed in and closing the recess to at least partially cover the barrier film.

10. The disposable device of claim 8, further comprising a cover disposed in and closing the recess and covering the barrier film.

11. The disposable device of claim 10, wherein the cover and the barrier film are configured to necessitate a two-step operation to activate the heat-producing material.

12. The disposable device of claim 10, wherein the cover is die cut from the sleeve and secured to the sleeve with multiple ties.

13. The disposable device of claim 1, wherein the inner surface of the sleeve is defined by a metallized layer that reflects heat from the inner surface of the sleeve.

14. The disposable device of claim 1, wherein the sleeve is a planar strip having opposite edges and means for joining the opposite edges together so that the sleeve acquires and maintains a tubular shape with an interior passage.

15. The disposable device of claim 1, wherein the sleeve has a tubular shape, the disposable device is installed on the container, and the container is received in an interior passage defined by the tubular shape of the sleeve.

16. The disposable device of claim 1, wherein the disposable device is configured to be arranged in a compact configuration wherein the sleeve is a planar strip, and a second configuration in which ends of the sleeve are attached to each other so that the sleeve defines interior passage that is sized and able to conform to an exterior shape of the container such that the container contacts the housing.

* * * * *